US009030277B2

(12) United States Patent
Chen et al.

(10) Patent No.: US 9,030,277 B2
(45) Date of Patent: May 12, 2015

(54) COMPACT MICROWAVE DISTRIBUTED-ELEMENT DUAL-MODE BANDPASS FILTER

(71) Applicant: JianXin Chen, Nantong (CN)

(72) Inventors: JianXin Chen, Nantong (CN); C-Y Li, Nantong (CN); Yang Zhan, Nantong (CN); Hui Tang, Nantong (CN); LiHeng Zhou, Nantong (CN); Jin Shi, Nantong (CN); ZhiHua Bao, Nantong (CN)

(73) Assignee: Nantong University, Nantong (CN)

( * ) Notice: Subject to any disclaimer, the term of this patent is extended or adjusted under 35 U.S.C. 154(b) by 120 days.

(21) Appl. No.: 13/920,429

(22) Filed: Jun. 18, 2013

(65) Prior Publication Data

US 2014/0218135 A1 Aug. 7, 2014

(30) Foreign Application Priority Data

Feb. 5, 2013 (CN) ..... 2013 1 0047079
Apr. 15, 2013 (CN) ..... 2013 1 0130202

(51) Int. Cl.
*H01P 1/203* (2006.01)
*H01P 1/213* (2006.01)

(52) U.S. Cl.
CPC ..... *H01P 1/2135* (2013.01)

(58) Field of Classification Search
USPC ..... 333/204–206, 219.1
See application file for complete search history.

(56) References Cited

U.S. PATENT DOCUMENTS 5,703,546 A * 12/1997 Takahashi et al. ..... 333/204
7,268,648 B2 * 9/2007 Okamura et al. ..... 333/204
7,312,676 B2 * 12/2007 Kundu ..... 333/204

* cited by examiner

*Primary Examiner* — Dinh Le

(57) ABSTRACT

A compact microwave distributed-element dual-mode bandpass filter is provided, comprising a dual-mode resonator and a signal input port and a signal output port coupled electrically to the dual-mode resonator respectively; wherein, the dual-mode resonator comprises a main stripline with a center-loaded short-circuited stub, the main stripline is reasonably folded in both vertical and horizontal directions and is reasonably folded into a first layer, a second layer, a third layer and a fourth layer; a symmetrical plane is provided between the second layer and the third layer, while the first layer and the fourth layer are symmetrical to each other relative to the symmetrical plane, the second layer and the third layer are symmetrical to each other relative to the symmetrical plane as well; the center-loaded short-circuited stub is located on the symmetrical plane, and the symmetrical plane can be treated as a virtual ground at odd-mode resonant frequency.

6 Claims, 5 Drawing Sheets

COMPACT MICROWAVE DISTRIBUTED-ELEMENT DUAL-MODE BANDPASS FILTER

CROSS-REFERENCE TO RELATED APPLICATIONS

This non-provisional application claims priorities under 35 U.S.C. §119(a) on Patent Application No. 201310047079.9 filed in P.R. China on Feb. 5, 2013, and Patent Application No. 201310130202.3 filed in P.R. China on Apr. 15, 2013, the entire contents of which are hereby incorporated by reference.

FIELD OF THE INVENTION

The present invention relates to microwave communication field, more particularly to a compact microwave distributed-element dual-mode bandpass filter.

BACKGROUND OF THE INVENTION

Recently, the rapid development of modern wireless communication systems demands ever-greater functionality, higher performance, and lower cost in smaller and lighter formats. As high-order filters may be used to obtain better bandpass performance, which will obviously increase circuit size. Since the dual-mode resonator can be used as a doubly tuned resonant circuit, the number of resonators for a given degree of filter can be reduced to half, resulting in miniaturized filter configuration. Many dual-mode bandpass filters (BPFs) with good performance have been developed, for example, a dual-mode filter loaded with open-circuited stubs or short-circuited stubs. However, further size reduction for the printed circuit board (PCB) technology becomes a practical problem.

The dual-mode filters utilizing the low temperature co-fired ceramic (LTCC) technology based on the lumped element (L and C) or semi-lumped element design have sprung up. However, as the frequency increases, the parasitic effect, coupling effect and values of the lumped elements can not be accurately predicted and controlled, which would be a common problematic issue in precise and wideband filter designs.

In contrast, the transmission-line-based LTCC filters have no such problems of accurately predicting and controlling the parasitic effect, coupling effect and values of the lumped elements except the large circuit size. Up to now, how to construct a dual-mode filter with distributed elements in smaller and lighter format is still a master challenge.

SUMMARY OF THE INVENTION

The object of the present invention is to provide a compact microwave distributed-element dual-mode bandpass filter which has good performance and small size, aiming at above disadvantages in the prior art.

A compact microwave distributed-element dual-mode bandpass filter is provided, comprising a dual-mode resonator and a signal input port and a signal output port coupled electrically to the two open-circuited ends of the dual-mode resonator respectively; wherein, the dual-mode resonator comprises a main stripline with a center-loaded short-circuited stub, and the main stripline is reasonably folded in both vertical and horizontal directions and is reasonably folded into a first layer, a second layer, a third layer and a fourth layer from top to bottom in the vertical direction which are connected sequentially through main stripline connecting metallized through-holes, and the short-circuited stub comprises a branch stripline and a short-circuited stub connecting metallized through-hole connected to the actual ground; a symmetrical plane is provided between the second layer and the third layer, while the first layer and the fourth layer are symmetrical to each other relative to the symmetrical plane, the second layer and the third layer are symmetrical to each other relative to the symmetrical plane as well; the short-circuited stub is located on the symmetrical plane, and the symmetrical plane can be treated as a virtual ground at odd-mode resonant frequency.

Advantageously, the compact microwave distributed-element dual-mode bandpass filter further comprises a first grounding metal plate set above the first layer and a second grounding metal plate set below the fourth layer, and the short-circuited stub is communicated to the first grounding metal plate and the second grounding metal plate respectively.

Advantageously, a distance between the first layer and the first grounding metal plate, a distance between the second layer and the virtual ground, a distance between the third layer and the virtual ground and a distance between the fourth layer and the second grounding metal plate are equal.

Advantageously, the main stripline is a wire bent orderly through the low temperature co-fired ceramic technology with a uniform width.

The following advantages can be obtained with the compact microwave distributed-element dual-mode bandpass filter according to the present invention that since a 3-dimention (3-D) circuit layout can be constructed through folding the main stripline in both vertical and horizontal directions, not only good performance but also miniaturized size can be maintained, thus conforming to the demand of developing the miniaturized circuits.

BRIEF DESCRIPTION OF THE DRAWINGS

Further explanations to the present invention will be given referring to the appended drawings and embodiments, in the drawings:

FIG. 3(*b*) shows the side view of the resonator in FIG. 3(*a*);

DETAILED DESCRIPTION OF THE PREFERRED EMBODIMENTS

Further explanations to the present invention will be given referring to the appended drawings and embodiments.

Figure 1:
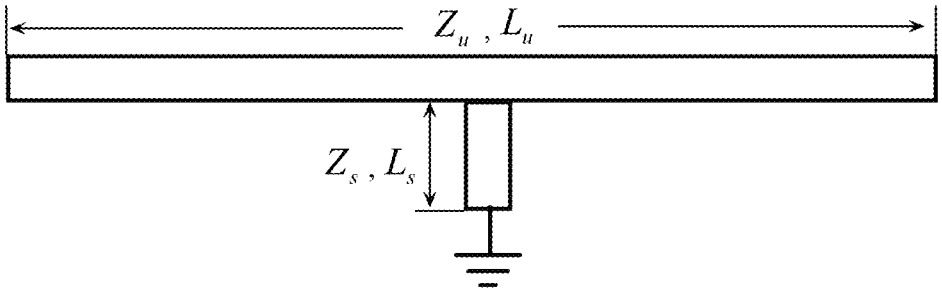
FIG. 1 shows a plane diagram of a dual-mode resonator in a compact microwave distributed-element dual-mode bandpass filter.
Figure 3A:
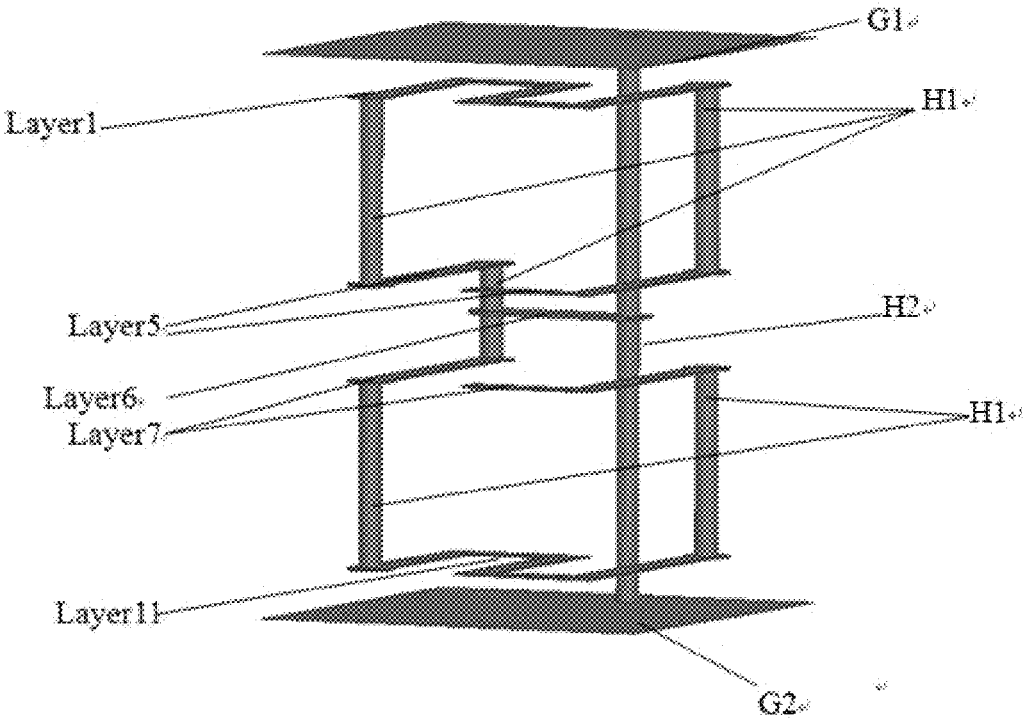
FIG. 3(*a*) shows the basic structure of a resonator in the compact microwave distributed-element dual-mode bandpass filter according to a preferred embodiment of the present invention.
Figure 3B:
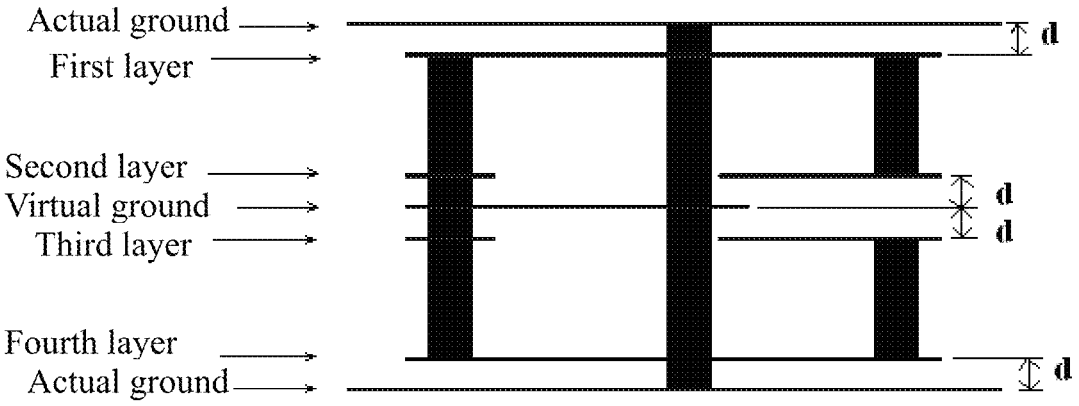

Referring to FIG. 1 which shows a plane diagram of the resonator shown in FIGS. 3(*a*) and 3(*b*), although the main stripline is folded in the 3-D space, it can be regarded as the main stripline with a center-loaded short-circuited stub and both ends open-circuited shown in FIG. 1 because of its symmetrical structure. In FIG. 1, Lu and Zu are the physical length and the characteristic impedance of the main stripline respectively, and Ls and Zs are the physical length and the characteristic impedance of the short-circuited stub respectively. To simplify the analysis, it is assumed that Zu=2Zs, the odd- and even-mode resonant frequencies can be obtained.

The odd-mode resonant frequency $f_{odd}$ of the compact microwave distributed-element dual-mode bandpass filter can be obtained $$f_{odd} = \frac{c}{2L_u\sqrt{\varepsilon_{eff}}}$$

where c is the speed of the light in free space, $\in_{eff}$ is the effective dielectric constant, and $L_u$ is the physical length of the main stripline in FIG. 1.

The even-mode resonant frequency $f_{even}$ of the compact microwave distributed-element dual-mode bandpass filter can be obtained $$f_{even} = \frac{c}{2(L_u + L_s)\sqrt{\varepsilon_{eff}}}$$

where c is the speed of the light in free space, $\in_{eff}$ is the effective dielectric constant, $L_u$ is the physical length of the main stripline in FIG. 1, and $L_s$ is the physical length of the short-circuited stub in FIG. 1.

It can be found that the short-circuited stub has no effect on $f_{odd}$ while it can be used to control $f_{even}$.

Figure 2:
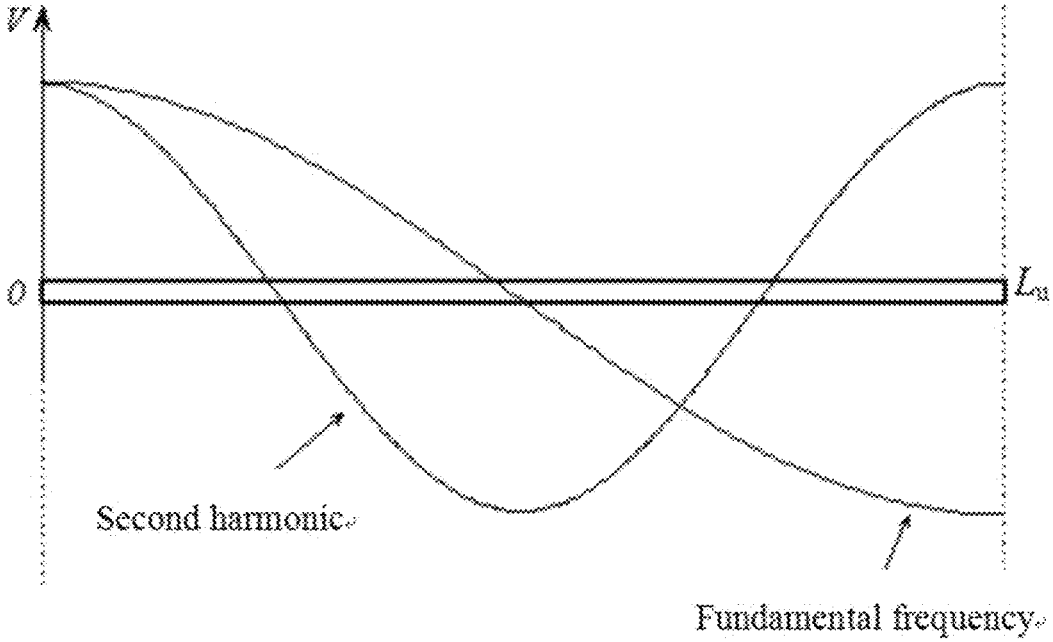
FIG. 2 shows the distributing of the normalized voltage wave along the open-ended half-wavelength resonator.

Referring to FIG. 2, $L_u$ represents the physical length of the main stripline that constitutes the resonator. The voltage at the centre of the main stripline is zero when the resonator is at fundamental resonant frequency. According to the basic circuit theory, it is believed that the centre of the main stripline is short-circuited in the symmetrical plane of the 3-D resonator, namely connected to the ground, at fundamental resonant frequency. So the symmetrical plane can be treated as a virtual ground at fundamental resonant frequency.

Referring to FIGS. 3(*a*) and 3(*b*), the dual-mode resonator comprises a main stripline with a center-loaded short-circuited stub, and the main stripline is reasonably folded in both vertical and horizontal directions and is reasonably folded into a first layer, a second layer, a third layer and a fourth layer from top to bottom in the vertical direction which are connected sequentially through main stripline connecting metallized through-holes H1, and the short-circuited stub comprises a branch stripline and a short-circuited stub connecting metallized through-hole H2 connected to the actual ground; a symmetrical plane is provided between the second layer and the third layer, while the first layer and the fourth layer are symmetrical to each other relative to the symmetrical plane, the second layer and the third layer are symmetrical to each other relative to the symmetrical plane as well; the short-circuited stub is located on the symmetrical plane, and the symmetrical plane can be treated as a virtual ground at odd-mode resonant frequency.

Figure 4:
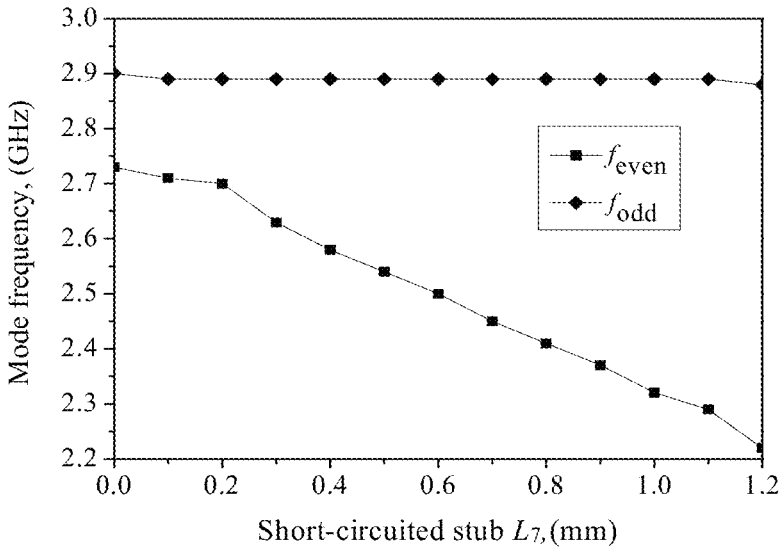
FIG. 4 shows the relationship between the two resonant frequencies and the short-circuited stub in the resonator shown in FIG. 3(*a*)

FIG. 4 shows the changes of the two mode resonant frequencies when different lengths $L_7$ of short-circuited stubs are loaded. It can be found that $f_{even}$ shifts down as $L_7$ increases, while $f_{odd}$ keeps unchanged.

Figure 5:
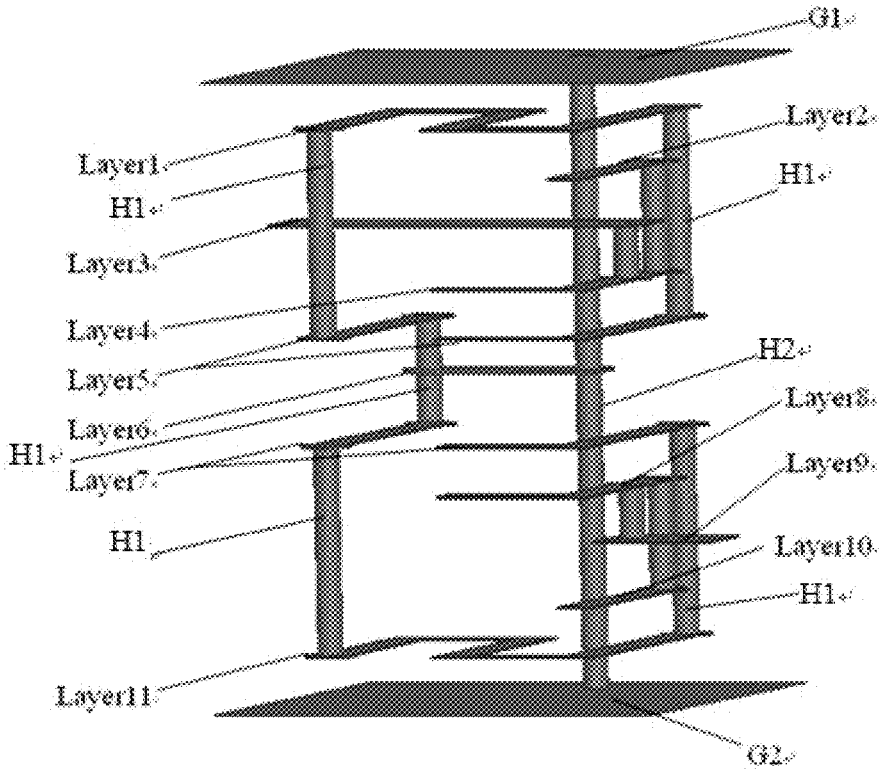
FIG. 5 shows the basic structure of the compact microwave distributed-element dual-mode bandpass filter according to a preferred embodiment of the present invention.

Referring to FIG. 5 which shows the basic structure of the compact microwave distributed-element dual-mode bandpass filter according to a preferred embodiment of the present invention, the filter comprises a dual-mode resonator and a signal input port and a signal output port coupled electrically to the two open-circuited ends of the dual-mode resonator respectively. Referring to FIG. 3(*b*), the dual-mode resonator comprises a main stripline with a center-loaded short-circuited stub, and the main stripline is reasonably folded in both vertical and horizontal directions and is reasonably folded into a first layer, a second layer, a third layer and a fourth layer from top to bottom in the vertical direction which are connected sequentially through main stripline connecting metallized through-holes H1, and the short-circuited stub comprises a branch stripline and a short-circuited stub connecting metallized through-hole H2 connected to the actual ground; a symmetrical plane is provided between the second layer and the third layer, while the first layer and the fourth layer are symmetrical to each other relative to the symmetrical plane, the second layer and the third layer are symmetrical to each other relative to the symmetrical plane as well; the short-circuited stub is located on the symmetrical plane, and the symmetrical plane can be treated as a virtual ground at odd-mode resonant frequency.

For example, in one embodiment, both ends of the main stripline are open-circuited, and the signal input port and the signal output port are coupled electrically to two open-circuited ends of the main stripline respectively. It should be understood that both ends of the main stripline may be short-circuited while the signal input port and the signal output port are coupled electrically to two short-circuited ends of the main stripline respectively. However, the main stripline described below are all with open-circuited ends as examples.

Subsequently, referring to FIG. 5, the compact microwave distributed-element dual-mode bandpass filter is divided into eleven layers in vertical direction, comprising Layer1, Layer2, Layer3, Layer4, Layer5, Layer6, Layer7, Layer8, Layer9, Layer10 and Layer11 from up to bottom. Wherein, the main stripline in the dual-mode resonator is folded into four layers in the vertical direction, comprising Layer1 (corresponding to the first layer shown in FIG. (3*b*)), Layer5 (corresponding to the second layer shown in FIG. (3*b*)), Layer7 (corresponding to the third layer shown in FIG. (3*b*)) and Layer11 (corresponding to the fourth layer shown in FIG. (3*b*)). Layer1 and Layer5 are symmetrical to Layer11 and Layer7 respectively relative to the symmetrical plane Layer6. Layer2, Layer3, Layer4 and some other metallized through-holes connected with them constitute the feedline at one side while Layer8, Layer9, Layer10 and some other metallized through-holes connected with them constitute the feedline at the other side. Layer2, Layer4, Layer8 and Layer10 are parts of the signal input feedline or output feedline of the filter, and they are symmetrical relative to the symmetrical plane Layer6 as well.

Preferably, referring to FIG. 3(*b*) and FIG. 5, the compact microwave distributed-element dual-mode bandpass filter further comprises a first grounding metal plate G1 set above the first layer (corresponding to the Layer1 shown in FIG. 5) and a second grounding metal plate G2 set below the fourth layer (corresponding to the Layer11 shown in FIG. 5), and the short-circuited stub is communicated to the first grounding metal plate and the second grounding metal plate respectively, thus forming a return circuit. Wherein, the first grounding metal plate G1 and the second grounding metal plate G2 are communicated to the ground directly, and can be treated as the actual ground.

Preferably, referring to FIG. 3(*b*) and FIG. 5, the distance between the first layer (namely the Layer1 in FIG. 5) and the nearer actual ground (namely the first grounding metal plate G1 in FIG. 5), the distance between the second layer (namely the Layer5 in FIG. 5) and the virtual ground (namely the Layer6 in FIG. 5), the distance between the third layer (namely the Layer7 in FIG. 5) and the virtual ground (namely the Layer6 in FIG. 5) and the distance between the fourth layer (namely the Layer11 in FIG. 5) and the nearer actual ground (namely the second grounding metal plate G2 in FIG. 5) are equal, for example, referring to FIG. 3(*b*), all the distances are equal to d.

With the compact microwave distributed-element dual-mode bandpass filter according to the present invention, since a 3-dimention (3-D) circuit layout can be constructed through folding the main stripline in both vertical and horizontal directions, not only good performance but also miniaturized size can be maintained, thus conforming to the demand of developing the miniaturized circuits.

Figure 6:
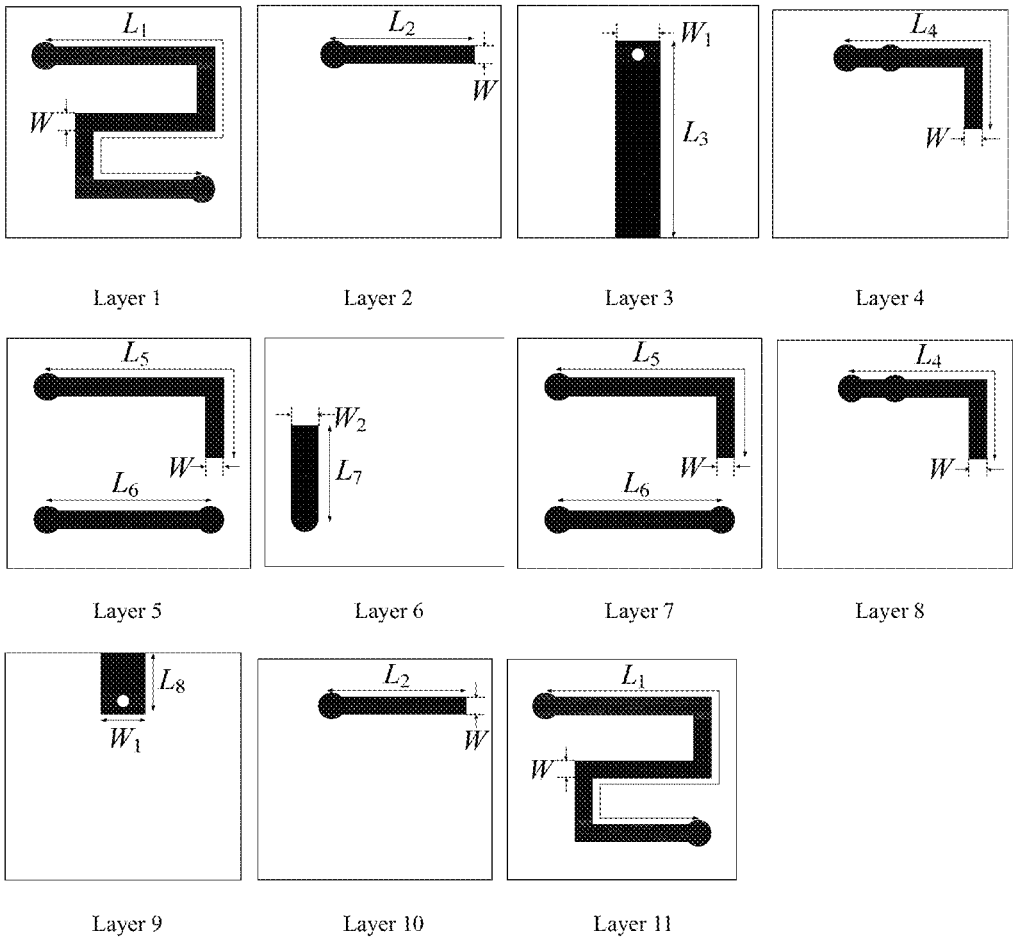
FIG. 6 shows the layout of each layer in the compact microwave distributed-element dual-mode bandpass filter shown in FIG. 5.

FIG. 6 shows the layout of each layer in the compact microwave distributed-element dual-mode bandpass filter shown in FIG. 5. The Layer1-Layer11 in FIG. 5 are respectively corresponding to the layers from top to bottom in FIG. 5. It can be found out from FIG. 6 that the Layer1, Layer2, Layer4, Layer5 are symmetrical to Layer 11, Layer10, Layer8, Layer7 respectively relative to the symmetrical plane (namely the Layer6 in the figure).

Figure 7:
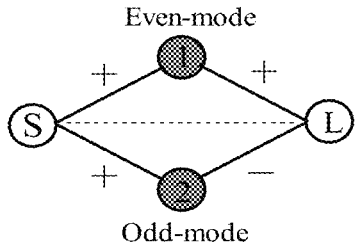
FIG. 7 shows the coupling scheme of the compact microwave distributed-element dual-mode bandpass filter shown in FIG. 5.

Referring to FIG. 7 which shows the coupling scheme of the compact microwave distributed-element dual-mode bandpass filter shown in FIG. 5, the dark circles 1 and 2 denote the even and odd modes of the dual-mode BPF, respectively. There isn't coupling between the even and odd modes. The blank circles S and L denote the source and load, respectively. In this design, the coupling between the source and load is represented by the dash line. The odd and even modes in the dual-mode resonator, as well as the source and the load, form a coupling route respectively. In the case that there are several coupling routes, the filter can obtain a transmission zero in the right side of its passband when it makes the signal phase-shifted by ±90° according to the cross-coupling theory. Another transmission zero can be obtained in the left side of the passband through the introducing of the coupling between the source and the load, enabling the filter to obtain sharp rejection skirts and improve the selectivity significantly.

A dual-mode BPF centered at 2.45 GHz can be designed with a 3 dB fractional bandwidth (FBW) 27.3%. The desired filter response has two transmission zeros at normalized frequencies $S_1$=−j13.2 and $S_2$=j3.6 with an in-band return loss of 17 dB.

The corresponding coupling matrix M is obtained as $$M = \begin{bmatrix} & S & 1 & 2 & L \\ S & 0 & 0.64095 & 0.86249 & 0.035 \\ 1 & 0.64095 & -1.308 & 0 & 0.64095 \\ 2 & 0.86249 & 0 & 1.408 & -0.86249 \\ L & 0.035 & 0.64095 & -0.86249 & 0 \end{bmatrix}$$

Specifically, in practical implement, the parameters shown in FIG. 6 are listed as follows: W=0.2 mm, $W_1$=0.5 mm, $W_2$=0.3 mm, $L_1$=6.1 mm, $L_2$=1.55 mm, $L_3$=2.2 mm, $L_4$=2.25 mm, $L_5$=2.65 mm, $L_6$=1.8 mm, $L_7$=1.05 mm, $L_8$=0.7 mm. And the diameters of the metallized through-holes are 0.15 mm.

Figure 8:
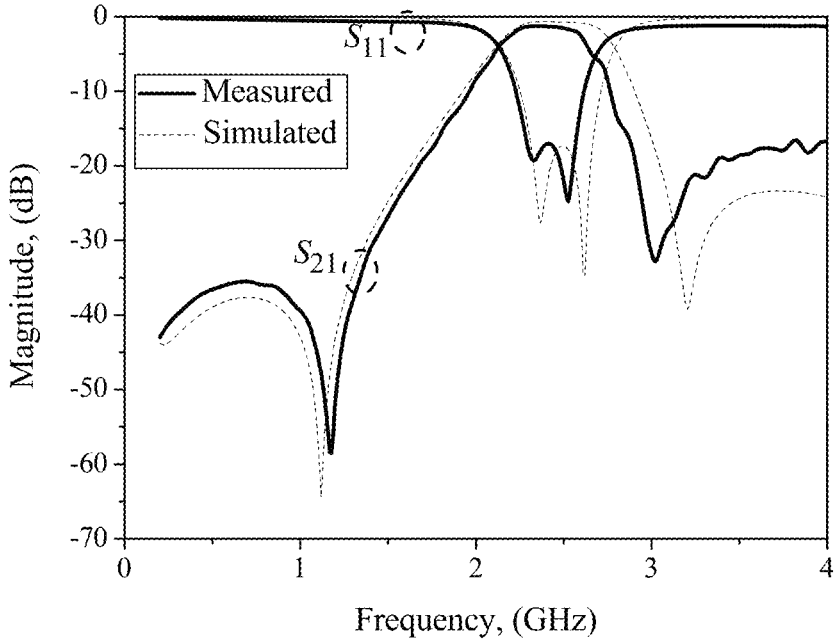
FIG. 8 shows the simulated and measured results of the compact microwave distributed-element dual-mode bandpass filter shown in FIG. 5.

Referring to FIG. 8 which shows the simulated and measured results of the compact microwave distributed-element dual-mode bandpass filter shown in FIG. 5, the solid line represents the measured result and the dashed line represents the simulated result. The simulated and measured results are accomplished by using the full-wave EM simulator HFSS of Ansoft and E5071C network analyzer, respectively. It can be seen from FIG. 8 that the measured result shows that the minimum insertion loss is 1.3 dB, including the SMA connectors' losses. The measured return loss is better than 15 dB in the passband. Two transmission zeros, which are realized at 1.18 GHz and 3.0 GHz, improve the selectivity of the proposed BPF significantly. There are slight discrepancies between the simulated and measured results, which can be attributed to the fabrication tolerance and test implementation.

In a proffered embodiment of the present invention, the LTCC technology can be applied to the filter as it is widely used in constructing the 3-D structure. Advantageously, the main stripline of any structure in the present invention can be obtained by bending a wire with a uniform width orderly through the LTCC technology.

The foregoing description of the exemplary embodiments of the invention has been presented only for the purposes of illustration and description and is not intended to be exhaustive or to limit the invention to the precise forms disclosed. Any modifications and variations are possible in light of the above teaching without departing from the protection scope of the present invention.

What is claimed is:

1. A compact microwave distributed-element dual-mode bandpass filter comprising a dual-mode resonator and a signal input port and a signal output port coupled electrically to two open-circuited ends of the dual-mode resonator respectively; wherein, the dual-mode resonator comprises a main stripline with a center-loaded short-circuited stub, the main stripline is folded in both vertical and horizontal directions and is folded into a first layer, a second layer, a third layer and a fourth layer from top to bottom in the vertical direction which connected sequentially through main stripline connecting metallized through-holes, and the center-loaded short-circuited stub comprises a branch stripline and a short-circuited stub connecting metallized through-hole connected to actual ground; a symmetrical plane is provided between the second layer and the third layer, while the first layer and the fourth layer are symmetrical to each other relative to the symmetrical plane, the second layer and the third layer are symmetrical to each other relative to the symmetrical plane as well; the center-loaded short-circuited stub is located on the symmetrical plane, and the symmetrical plane can be a virtual ground at odd-mode resonant frequency.

2. The compact microwave distributed-element dual-mode bandpass filter of claim 1, wherein, the compact microwave distributed-element dual-mode bandpass filter further comprises a first grounding metal plate set above the first layer and a second grounding metal plate set below the fourth layer, and the center-loaded short-circuited stub is communicated to the first grounding metal plate and the second grounding metal plate respectively.

3. The compact microwave distributed-element dual-mode bandpass filter of claim 2, wherein, a distance between the first layer and the first grounding metal plate, a distance between the second layer and the virtual ground, a distance between the third layer and the virtual ground and a distance between the fourth layer and the second grounding metal plate are equal.

4. The compact microwave distributed-element dual-mode bandpass filter of claim 1, wherein, the main stripline is a wire bent orderly through a low temperature co-fired ceramic technique with a uniform width.

5. The compact microwave distributed-element dual-mode bandpass filter of claim 2, wherein, the main stripline is a wire bent orderly through a low temperature co-fired ceramic technique with a uniform width.

6. The compact microwave distributed-element dual-mode bandpass filter of claim 3, wherein, the main stripline is a wire bent orderly through a low temperature co-fired ceramic technique with a uniform width.

* * * * *